US006183075B1

(12) United States Patent
Sasaki

(10) Patent No.: US 6,183,075 B1
(45) **Date of Patent: *Feb. 6, 2001**

(54) INK CONTAINER, MANUFACTURING METHOD THEREFOR, INK JET CARTRIDGE AND INK JET APPARATUS

(75) Inventor: Toshiaki Sasaki, Abiko (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/661,867

(22) Filed: Jun. 11, 1996

(30) Foreign Application Priority Data

Jun. 13, 1995 (JP) ..... 7-146246
May 23, 1996 (JP) ..... 8-128357

(51) Int. Cl.[7] ..... B41J 2/175
(52) U.S. Cl. ..... 347/86
(58) Field of Search ..... 347/85, 86, 87; 215/12.1; 264/516

(56) References Cited

U.S. PATENT DOCUMENTS 4,816,305 * 3/1989 Stillwell et al. ..... 428/35.7
5,435,452 7/1995 Nishigami et al. ..... 215/12.1
5,742,311 * 4/1998 Koitabashi et al. ..... 347/86

FOREIGN PATENT DOCUMENTS 0 510 665 A2 10/1992 (EP) .
0510665 10/1992 (EP) .
0 542 247 A2 5/1993 (EP) .
0542247 5/1993 (EP) .
0 571 151 A2 11/1993 (EP) .
0571151 11/1993 (EP) .
0 605 183 A2 7/1994 (EP) .
0605183 7/1994 (EP) .
0 624 475 A2 11/1994 (EP) .
0624475 11/1994 (EP) .
0 640 482 A2 3/1995 (EP) .
0640482 3/1995 (EP) .
2281253 3/1995 (GB) .
61-93246 5/1986 (JP) .
63-12427 1/1988 (JP) .
4-267727 9/1992 (JP) .
4-339759 11/1992 (JP) .
5-77345 3/1993 (JP) .
5-213372 8/1993 (JP) .
5-213373 8/1993 (JP) .
5-254144 10/1993 (JP) .
6-13099 1/1994 (JP) .
6-27523 2/1994 (JP) .
6-211243 8/1994 (JP) .
316876 10/1997 (TW) .
WO 91/07240 5/1991 (WO) .

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink container for containing ink includes an inner container having a plurality of adjacent accommodating chambers for accommodating the ink; and an outer casing for enclosing an outer side of the inner container. The inner container and the outer casing are composed of resin materials which are substantially non-stretched.

24 Claims, 12 Drawing Sheets

FIG. 1(a)
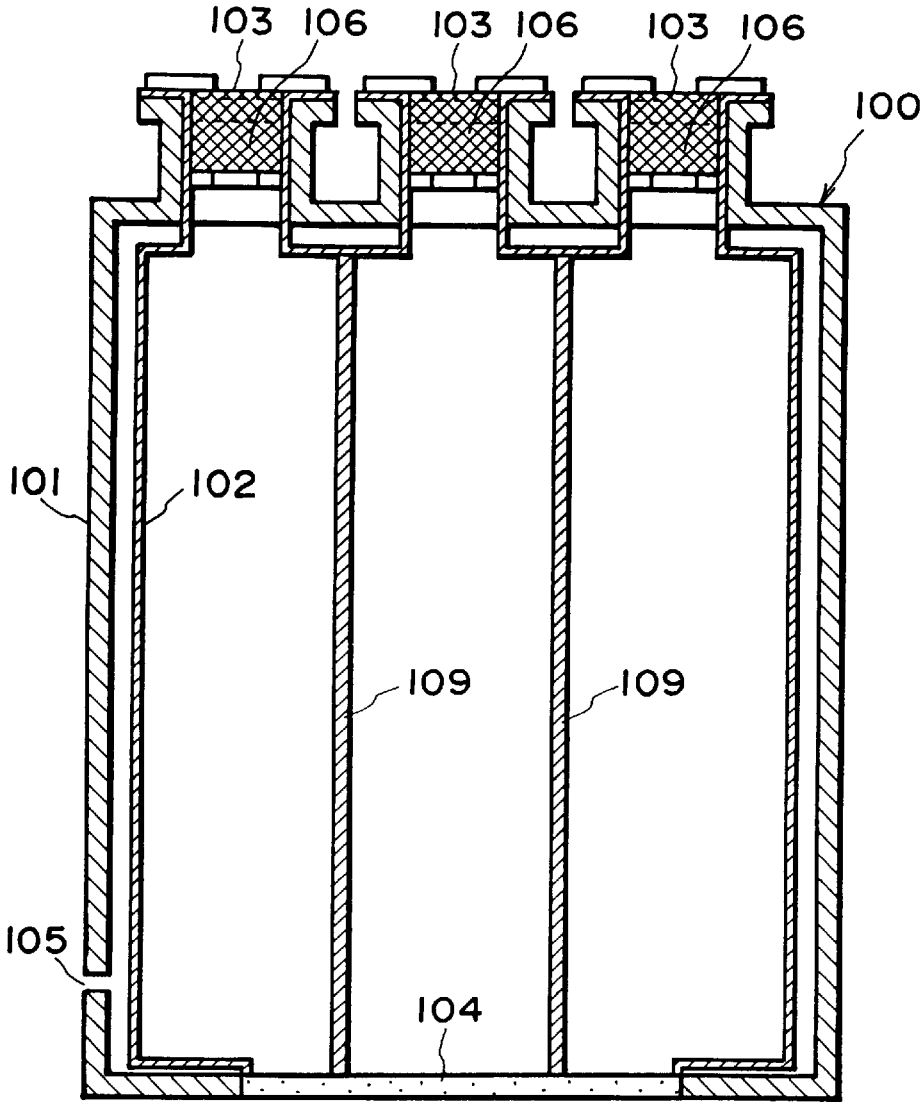
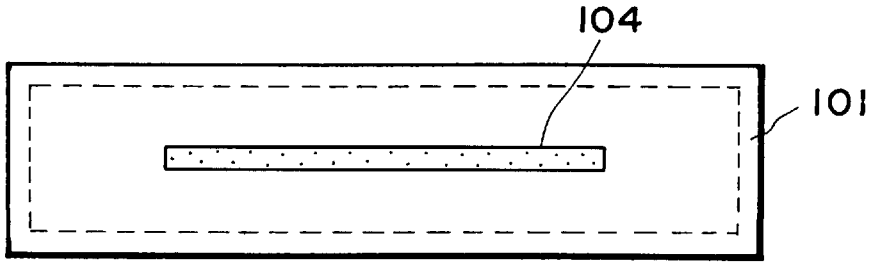
FIG. 1(b)

FIG. 4(a)
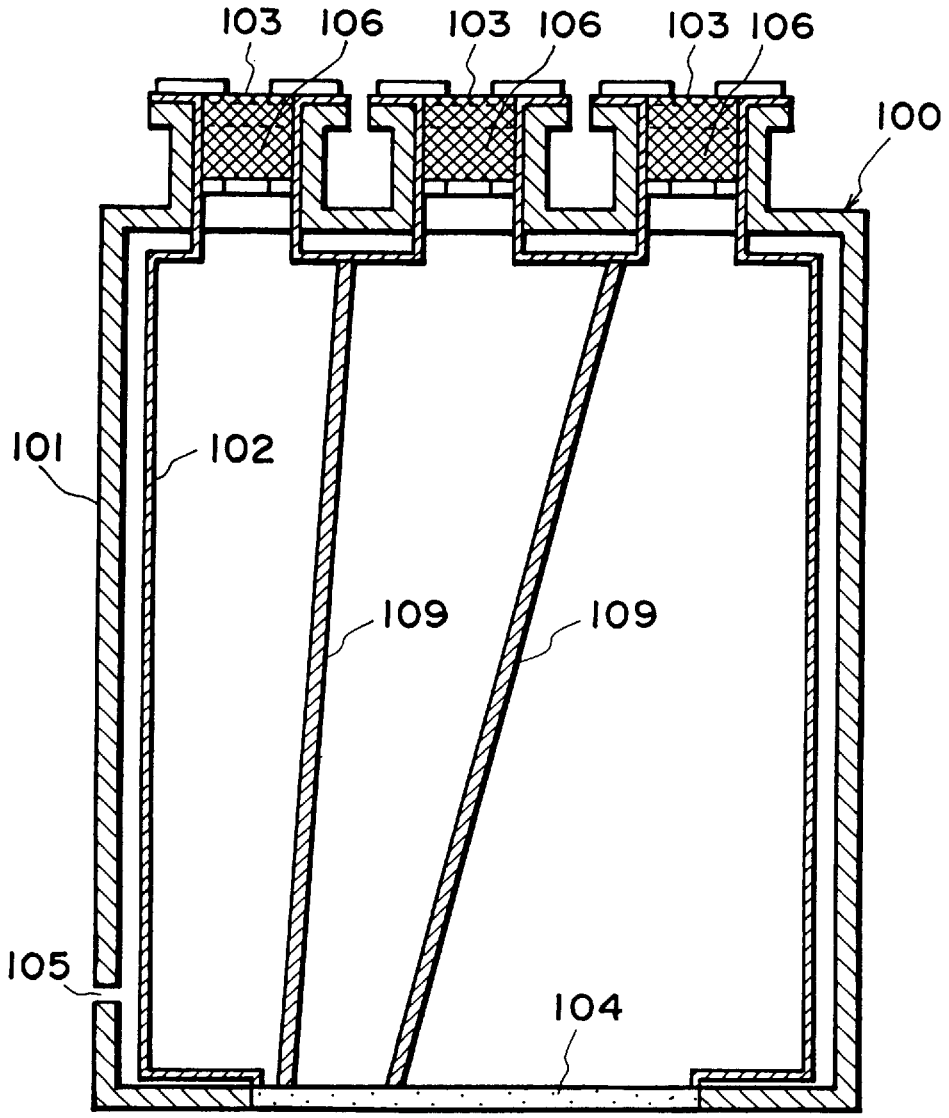
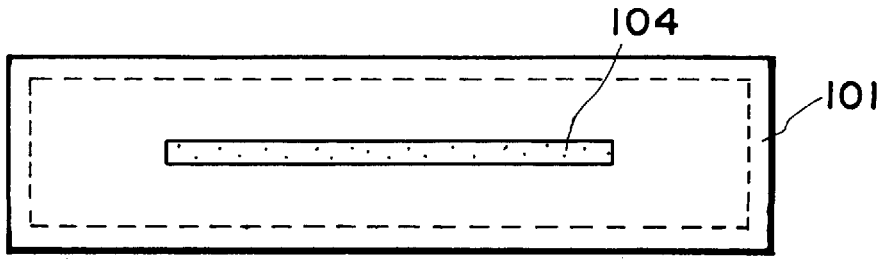
FIG. 4(b)

FIG. 5(a)
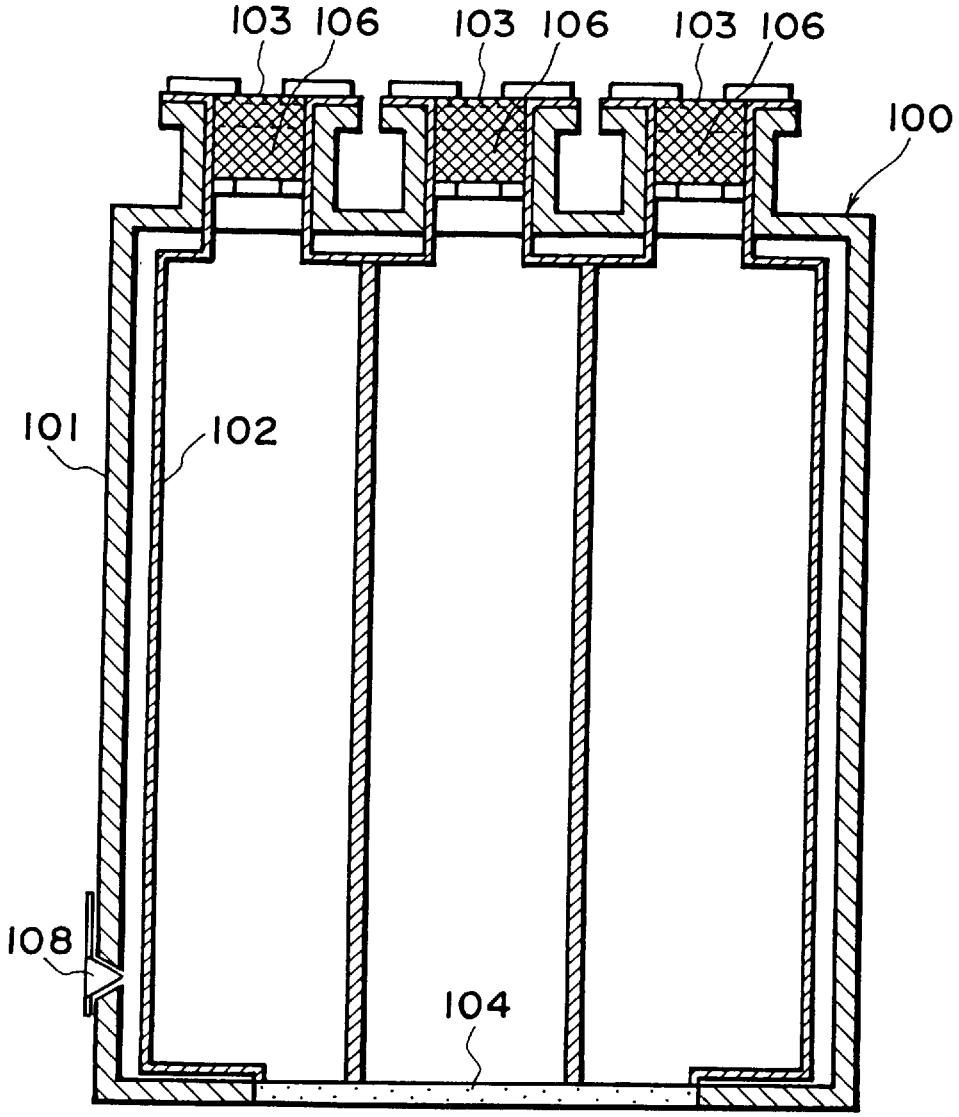
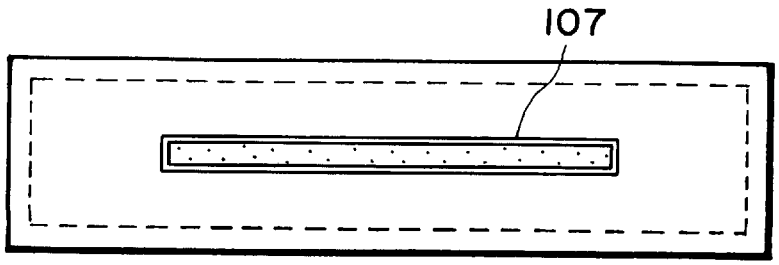
FIG. 5(b)

FIG. 6(a)
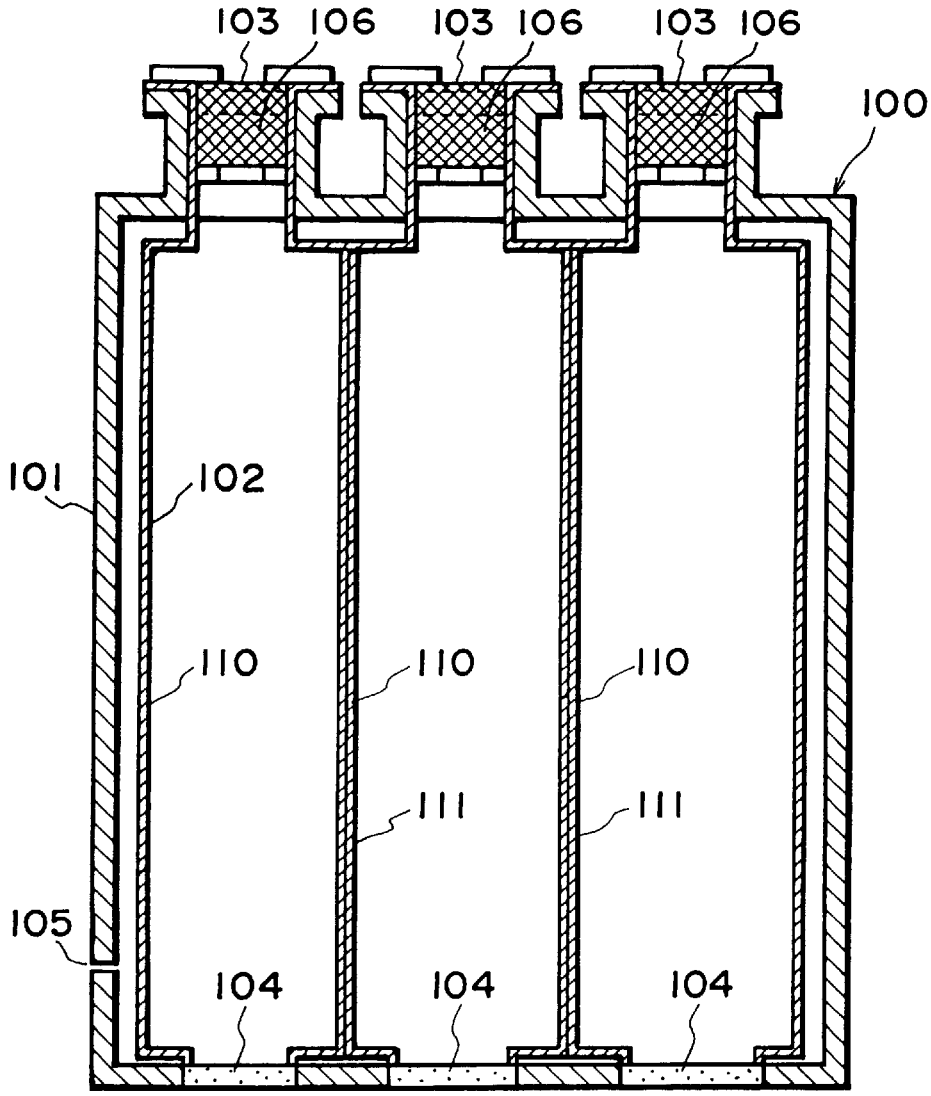
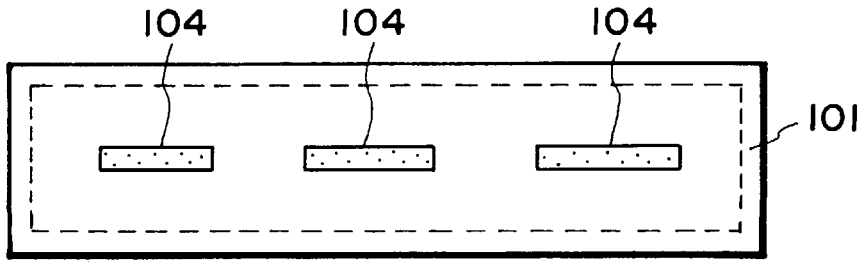
FIG. 6(b)

FIG. 10(a)
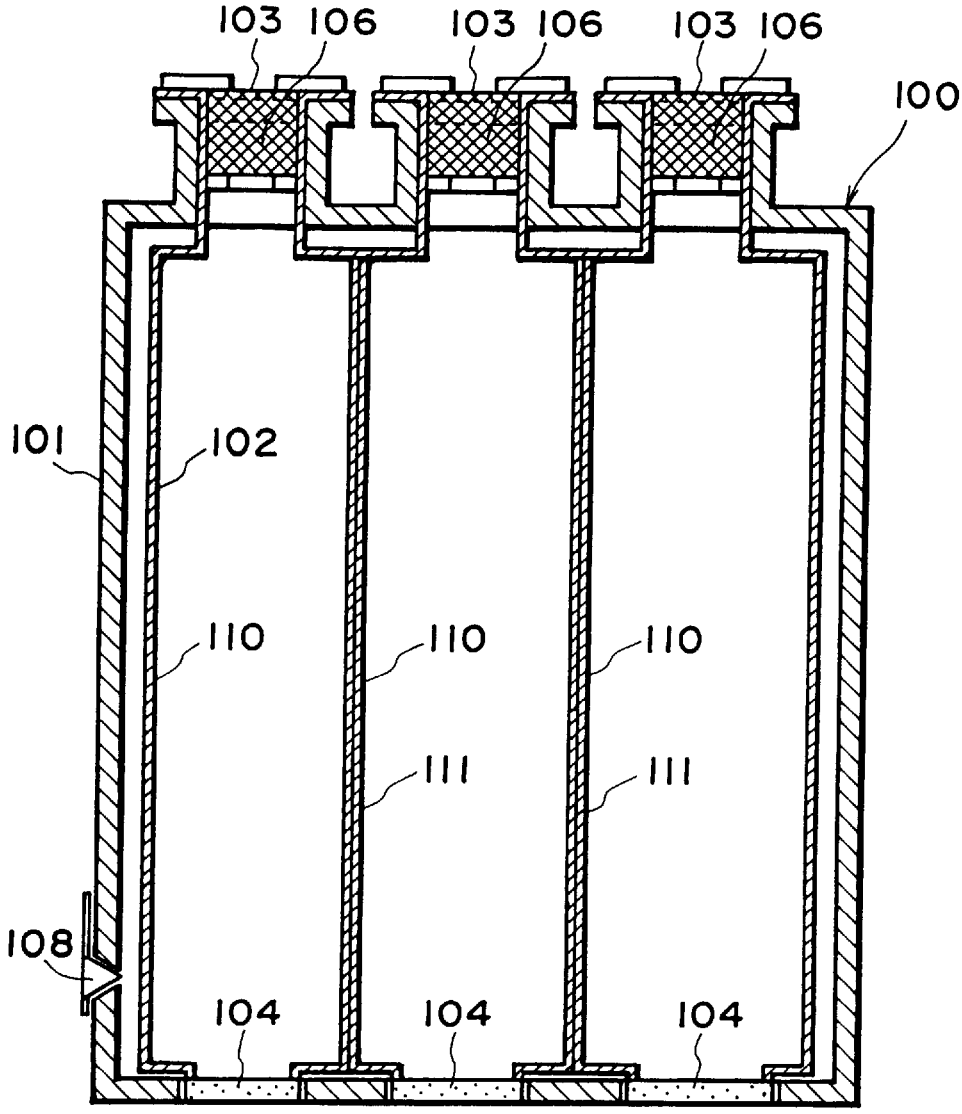
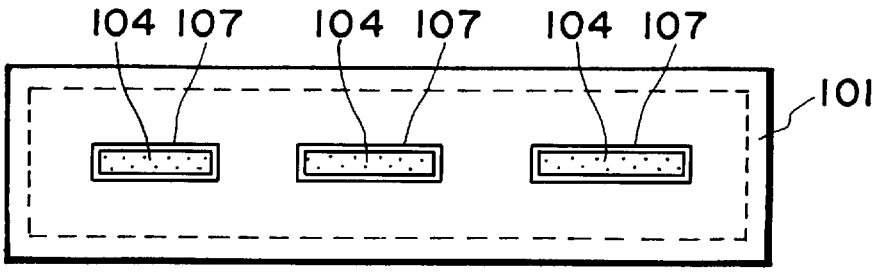
FIG. 10(b)

INK CONTAINER, MANUFACTURING METHOD THEREFOR, INK JET CARTRIDGE AND INK JET APPARATUS

FIELD OF THE INVENTION AND RELATED ART

In the field of ink jet recording, when a plurality of recording liquids (inks) are used for recording, various cartridge systems are employed. In these systems an ink holding portion (ink container) for holding recording liquids to be supplied to a recording means, comprising a section for generating energy for forming droplets of the recording liquid, are rendered removably installable in an ink jet recording apparatus.

These systems have been employed as a system effective to reduce the running cost of an ink jet recording apparatus, in particular, the running cost of such an ink jet recording apparatus that uses a plurality of inks in order to record in color or in the like mode.

As for the structure of the ink container in the form of a cartridge, there is a structure comprising a shell, and an internal pouch for containing the ink. Normally, this pouch is made of drawn film composed of resin material, and is laminated for physical strength and ink resistance. This is because drawn resin film displays directional properties in terms of tensile strength, that is, it tears easily when pulled in a certain direction, and therefore, thin resin films with superior tensile strength must be laminated for omnidirectional strength.

This pouch is inserted into the cartridge shell, and a lid is welded or simply fitted to the cartridge shell when the cartridge is manufactured.

When the ink container described above is employed, the recording means, and the portion at which the ink container is attached, are disposed at different elevations, in order to generate "negative pressure", which characterizes the ink jet recording technology. The negative pressure in this case is used to prevent the ink from leaking out of the ink ejecting portion, such as a nozzle provided in the recording means; it is a back pressure relative to the direction of the ink flow toward the recording means. Since this back pressure causes the pressure at the ejection orifice portion to be negative relative to the atmospheric pressure, it is called "negative pressure".

Presently, efforts are being made to provide a means for generating this negative pressure without relying on the elevation difference, so that the ink jet recording apparatus size can be reduced. One such means which has been employed is a structure, in which a member composed of porous material or the like for generating capillary force is placed in the ink container, and the ink is retained in the porous member.

However, when such a porous member is employed, the ink must be retained in the porous material, seriously limiting the ink holding efficiency per unit volume of the ink container.

Further, the pouch is formed using a so-called blow molding. Blow molding is used to produce feed containers and requires a laminar structure in which the layers are bonded to prevent separation. In particular, when the pouch is formed using direct blow molding, airtightness becomes mandatory at the flash portions.

When the aforementioned pouch is employed, it is rendered flexible so that it deforms as the ink is consumed, and is not provided with an air vent or the like structure; therefore, ink leakage due to the use of such an air vent or the like structure does not occur. Further, the ink is directly contained in the pouch; therefore, the ink holding efficiency per internal volume is relatively high.

However, in order to give the pouch the flexibility, the strength, and the capability to prevent the ink from evaporating, the pouch must be given a laminar structure, which complicates the overall structure, and increases the number of components. Therefore, the employment of the pouch also has a limit in terms of the ink holding efficiency per unit of internal volume of the cartridge.

The ink holding efficiency per unit of internal volume tends to decline as the number of ink holding portions is increased to hold a plurality of inks of different colors.

In addition, in order to accomplish the size reduction of an ink jet recording apparatus, a negative pressure generating means, which is a means that characterizes the field of ink jet recording, must be provided within the ink container. Therefore, when the flexible pouch is employed, it is necessary to provide the pouch with a spring or the like so that the pouch is resiliently deformed.

Such a structural provision also increases the component count of the apparatus, as well as the height of the apparatus, further contradicting the current trend, that is, the simplification of manufacturing process, the apparatus size reduction, and the increase in the number of ink holding portions.

SUMMARY OF THE INVENTION

Accordingly, a primary object of the present invention is to provide an ink container for holding a plurality of inks of different colors, which has a high ink holding efficiency, does not leak the ink, does not contaminate the user, is capable of generating a proper level of negative pressure, and allows the ink to be efficiently used for printing.

More specifically, the primary object of the present invention is to provide an ink container capable of preventing the ink held in the porous material disposed therein from accidentally leaking in various situations which occur while the ink container is transported or in storage, for example, when the ink container is dropped, is subjected to a sudden change in ambient temperature, or vibration, and also is capable of allowing a proper amount of air to enter, or exit from, the ink container, minimizing the amount of ink evaporation, and preventing inks of different colors from mixing with each other, while the ink cartridge is in use.

Thus the present invention proposes, as means for accomplishing the objects described above, an ink container for holding ink, which comprises an inner shell provided with a plurality of adjoining ink holding spaces, and an outer shell covering the external surface of the inner shell, wherein the walls of the inner and outer shells are constituted of virtually non-stretched resin materials.

Further, the present invention proposes a structure for an ink container for holding ink, which comprises an inner shell provided with a plurality of adjoining ink holding spaces, and an outer shell covering the external surface of the inner shell, wherein the corners of the inner shell are set in the corners of the outer shell in an orderly manner.

Further, the present invention proposes an ink container for holding ink, which comprises an inner shell provided with a plurality of adjoining ink holding spaces, and an outer shell covering the external surface of the said inner shell, wherein inner shell supporting members for regulating the deformation of the inner shell are provided at a plurality of locations on the outer shell.

In an ink container in accordance with any of the above proposals, it is preferable that the walls partitioning the plurality of adjoining ink holding spaces of the inner shell are rendered thicker than the other walls of the inner shell.

Further, the present invention proposes an ink jet cartridge comprising: an ink container comprising an inner shell provided with a plurality of adjoining ink holding spaces, and an outer shell covering the external surface of the said inner shell, wherein the corners of the inner shell are set in the corners of the outer shell in an orderly manner; and an ink jet head for ejecting ink, which is connected to the ink supplying portion of the ink container, as well as an ink jet recording apparatus in which such a cartridge is removably mountable.

Further, the present invention proposes a method for manufacturing an ink container which comprises an inner shell provided with a plurality of adjoining ink holding spaces, and an outer shell covering the external surface of the inner shell, comprising: a step in which a die used for forming the outer shell of an ink container, and resins for the outer shell and the inner shell, respectively, are prepared; a step in which a parison comprising a resin cylinder for forming the outer shell, which is smaller than the die, and a plurality of smaller resin cylinders for forming the inner shell, which are to be disposed within the resin cylinder for the outer shell, are formed; a step in which the parison is held in the die, and air is blown into each of the plurality of smaller resin cylinders for the inner shell in such a manner that the corners of the inner shell are set in the corners of the outer shell in an orderly manner; and a step in which the walls of the outer shell are separated from the walls of the inner shell.

When the ink container, the ink jet cartridge, or the method for manufacturing an ink container, which were proposed above, are employed, a plurality of inks having different colors can be held in substantially the entire space occupied by the ink container; therefore, ink holding efficiency is improved, and in addition, it is possible to provide an ink container which is capable of generating stable negative pressure in each ink holding portions, and is superior in ink utilization efficiency.

Further, the employment of the ink jet cartridge proposed above means it possible to provide an ink jet recording apparatus superior in ink holding efficiency and ink utilization efficiency.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a schematic drawing of the ink container in the first embodiment of the present invention, (*a*) being a sectional view, and (*b*) being a side view.

FIG. 4 is a schematic drawing of a modified version of the ink container described in the first embodiment of the present invention, (*a*) being a sectional view, and (*b*) being a side view.

FIG. 5 is a schematic drawing of another modified version of the ink container described in the first embodiment of the present invention, (*a*) being a sectional view, and (*b*) being a side view.

FIG. 6 is a schematic drawing of the ink container in the second embodiment of the present invention, (*a*) being a sectional view, and (*b*) being a side view.

FIG. 10 is a schematic drawing of a modified version of the ink container described in the second embodiment of the present invention, (*a*) being a sectional view, and (*b*) being a side view.

DETAILED DESCRIPTION OF THE INVENTION

Figure 2A:
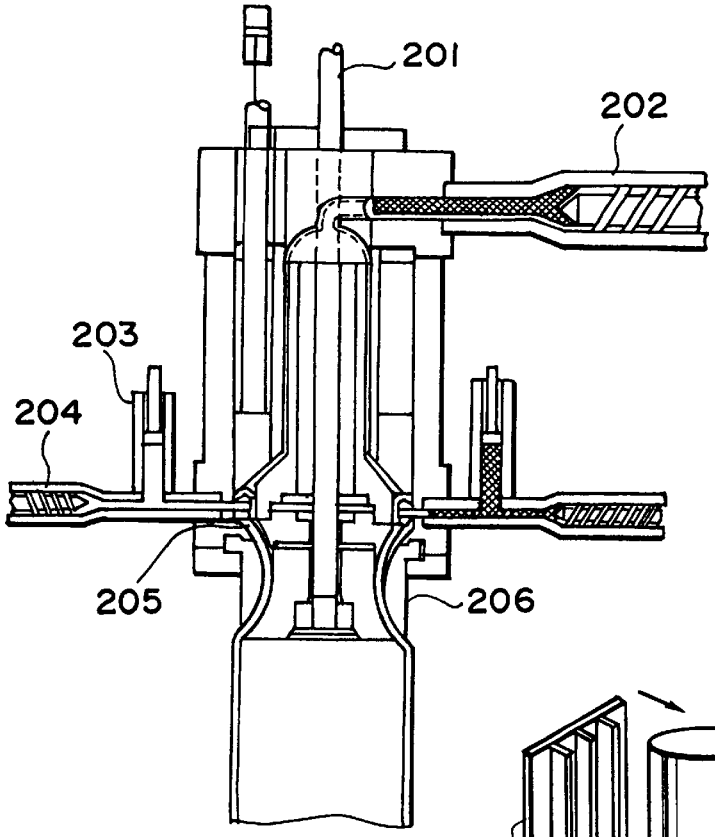
FIG. 2 is a explanatory drawing depicting an ink container manufacturing process, (*a*), (*b*), and (*c*), (*d*), and (*e*) sequentially illustrating various steps.
Figure 2B:
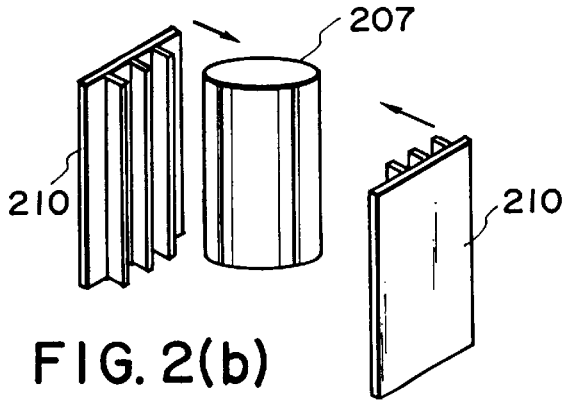
Figure 2C:
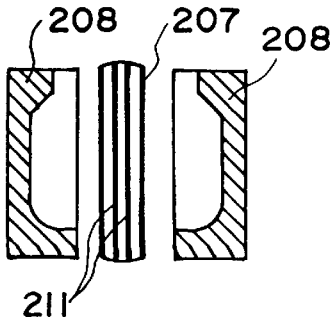
Figure 2D:
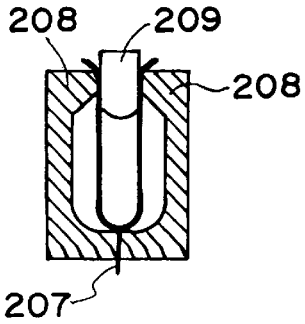
Figure 2E:
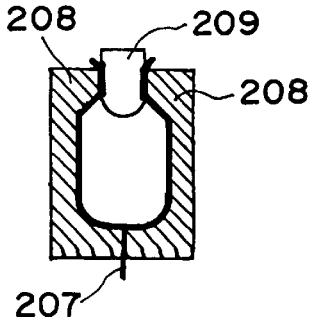

Hereinafter, the details of the embodiments of the present invention will be described with reference to the drawings. In the drawings, those designated by the same symbols are to have the same functions.

Embodiment 1

FIG. 1 is a schematic drawing showing the structure of the ink holding container in this embodiment, (*a*) being a sectional view and (*b*) being a side view. The following descriptions of the ink container will be given with reference to an ink container comprising an outer shell and an inner shell which are formed in a single process using blow molding.

In FIG. 1, a reference numeral 100 designates an ink container comprising an outer shell 101 and an inner shell 102. The outer and inner shells 101 and 102 are separable, wherein the internal surface of the shell 101 may be in contact with the exterior of the ink retaining inner shell 102, or a microscopic gap may be provided between them. The microscopic gap is filled with air. As for the materials of the inner shell 102 and the outer shell 101, they have only to be formable resin materials which are not adhesive to each other.

The inner shell 102 is provided with partition walls 109 for partitioning the internal space into a plurality of ink holding portions. These ink holding portions separated by the partition walls 109 are provided with an ink releasing port (ink supply port) 103, constituting a junction through which the ink is delivered to an unillustrated ink jet head as the recording means.

A reference numeral 104 designates a portion (pinch-off portion) to be welded to seal the internal space of the inner shell 102. This pinch-off portion is formed when the inner shell is engaged with the outer shell as they are formed by blow molding, and supports the inner shell 102. Referring to FIG. 1(*b*), the fused portion 104 in this embodiment looks linear, but the simple linear configuration is not mandatory; the configuration of the fused portion is optional as long as the ink container can be easily extracted from the die. Further, its length does not necessarily have to be limited to the length given in this embodiment; it is optional as long as the fused portion does not extend beyond the lateral walls.

Referring to FIG. 1(*a*), which is a schematic section of the ink container, the ink supply ports are drawn as ink supply ports whose locations do not correspond to the location of the fused portion 104 across the internal space of the ink container. However, when the ink supply ports are disposed at the locations which correspond to the fused portion 104 across the internal space, the fused portions will also be present on the supply ports.

The aforementioned partition wall 109 is also welded to the structural walls of the ink holding portions, and is rendered approximately two or more times thicker than the other structural walls during the manufacturing process, which will be described later. This partition wall 109 is integral with the fused portion 104.

Therefore, as the ink contained in the inner shell is consumed, and the internal volume of the container decreases, the inner shell 102 is prevented from collapsing, by the ink supply port 103 and the pinch-off portion 104. The direction of the deformation is further regulated by the partition wall 109 integral with the pinch-off portion 104, that is, the fused portion.

As a result, the irregular deformation of the inner shell 102 is controlled so that stable negative pressure can be generated.

Incidentally, depending on the thickness of the inner shell, the fused portion 104 sometimes become separated from the outer shell as the ink container deforms. Even in such a situation, the direction of the deformation is regulated due to the longitudinal component of the fused portion 104. Therefore, even when the fused portion becomes dislodged from the outer shell, the deformation does not occur in an irregular manner, but rather, the deformation occurs in an orderly manner, maintaining balance.

A reference numeral 105 designates an air vent through which air is introduced between the inner shell 102 and the outer shell 101 when the volume of the inner shell 102 decreases in response to the consumption of the ink contained therein. It may be a simple opening or may be constituted of an air flow valve. In this embodiment, this air vent is a simple opening (hole).

Instead of providing the air vent 105, the gap formable between the pinch-off portion 104 and the outer shell 101 may be used as the air vent 105. In such a case, the inner shell 102 and the outer shell 101 are formed of materials which are low in adhesiveness to each other, and an external force is applied to the pinch-off portion to separate the inner shell 102 from the outer shell, creating a gap which is usable in place of the air vent 105.

A reference numeral 106 designates an ink releasing member. It has a function to prevent ink leakage; it is capable of preventing the ink from leaking from the ink supply portion when the ink container is subjected to slight vibration or slight external pressure. In this embodiment, it is composed of unidirectionally arranged ink absorbent fibrous material, being provided with a force to maintain meniscus. It virtually seals the ink holding portion, and when the ink tapping member of the ink jet head is inserted into the ink supply port, it enables the ink within the ink holding portion to be fed out while maintaining the airtight condition.

Depending on how the ink container 100 and the ink jet head are joined, the ink releasing member 106 as a member activable by contact pressure may be replaced with a rubber plug, a porous material, a valve, a filter, a resin piece, or the like.

In this embodiment, negative pressure was generated as the largest structural wall (which also constitutes the structural wall of the inner shell) of each ink holding portion deforms inward. When this deformation occurs, the edge areas and the partition walls of the ink holding portions barely deform, and instead, they function to regulate the elastic or plastic deformation of the structural walls. These edge portions are initially in contact with the outer shell 101, wherein the structural walls that mainly deform are the larger lateral walls of the flat ink container, which are parallel to the surface of FIG. 1.

Hereinafter, a manufacturing method for the ink container in this embodiment will be described.

The ink container proposed by the present invention employs a double structure composed of formable resin material. The outer shell is rendered thicker for strength, whereas the inner shell is rendered thinner for flexibility so that it can accommodate the volumetric change of the ink held therein. The material for the structural walls of the inner shell is ink resistant, and the material for the structural walls of the outer shell is preferred to have shock resistance or the like properties.

In this embodiment, a method using blow molding is employed so that the structural walls of the ink container can be formed without drawing the resin materials. Therefore, the inner shell of the ink container, which constitutes the ink holding portion, is enabled to substantially omnidirectionally withstand the load.

As a result, no matter which direction the ink remaining in the inner shell shifts after the ink contained in the inner shell is consumed by a certain amount, that is, even when the load is concentrated in a particular direction, the inner shell is not damaged, and therefore, the inner shell can reliably hold the ink, further improving the overall durability of the ink container. As for the choice of blow molding, injection blow molding, direct blow molding, and the like are available.

Next, the ink container manufacturing process based on each of the above methods will be described.

When the liquid container is manufactured using the injection blow molding, the following two steps are taken. First, the outer shell is prepared using a preformed parison. Next, a plurality of parisons which will become the walls of the ink holding portions, or a parison in which portions of the internal surface is partially adhered to the opposing portions of the internal surface, are pre-heated and then inserted into the parison for the outer shell, and is formed into the inner shell by blow molding, being forced to come in contact with the outer shell. As the same time liquid is sealed into the inner shell, and the atmospheric air is allowed to enter between the outer and inner shells, completing the ink container.

The material for the outer shell and the material for the inner shell may be optionally selected as long as the materials are self fusible or self adhesive. While blow molding, it is important to properly control the parison temperature.

On the other hand, the direct blow molding method comprises the following steps. First, the inner shell resins are partially fused to form a plurality of spaces, and then, the resin for the inner shell and the resin for the outer shell are injected into the die at the same time using multi-layer injection nozzles. Thereafter, the liquid is injected into the ink container and sealed therein.

While being injected, the inner shell resin and the outer shell resin may be in contact with each other, not necessarily entirely, or may be only partially in contact with each other. In this case, the resin materials for the inner and outer shell are selected so that the mutually facing surfaces of the respective shells do not adhere to each other.

When it is necessary to use materials belonging to the same group for the sake of the liquid contact related properties or the configuration of the ink container, the inner shell wall and the outer shell wall are given a laminar structure, wherein various resin materials are injected so that different materials are exposed on the mutually facing surfaces of the respective shells.

It is ideal to mold the inner shell so that the wall thickness becomes even throughout the shell, but the wall thickness may be locally reduced so that the wall can easily accommodate the change in internal pressure. The method for partially reducing the wall thickness is optionally selected depending on the internal structure of the liquid container, and the wall thickness is reduced in the direction parallel to the direction in which the resins are injected into the die.

The inner shell resin and the outer shell resin are in contact with each other at both ends of the shells, wherein the inner shell is supported by the outer shell, and the inner shell is given such a structure that allows the inner shell to deform to accommodate the internal pressure change of the liquid container.

The inner shell resin material and the outer shell resin material are selected so that they are not adhesive to each other; therefore, the container with the double wall structure, the outer and the inner walls of which are not adhering to each other, can be easily formed, being different from the conventional container formed using blow molding. The inner shell and the outer shell which are stuck together due to the blow molding pressure are separated by reducing the internal pressure of the inner shell, or by applying an external force.

Further, in order to separate the inner shell and the outer shell, materials which are different in their coefficient of thermal expansion (or thermal contraction) may be employed so that they become automatically separated from each other after their formation. This method can reduce the number of manufacturing steps.

Further, the inner shell and the outer shell may be separated after the ink container formation, by applying an external force to the fused inner shell portion formed as the end portion of the inner shell parison and the end portion of the outer shell parison are caused to make contact with each other in the die while the ink container is formed by blow molding, and the thus formed gap between the fused inner shell portion and the outer shell portion from which the fused inner shell portion has been separated may be used as the air vent.

The ink is preferred to be injected into the internal space of the inner shell of the ink container manufactured using one of the above described methods, by an amount equivalent to approximately 90% of the inner shell volume, after the internal space is vacuumed. This is for dealing with the changes which occur to the environment in which the ink container is placed; this is helpful to prevent the ink from leaking due to external physical force, a temperature change, and an atmospheric pressure change.

Further, by vacuuming the internal space of the inner shell before injecting the ink, the external surface of the inner shell is separated from the internal surface of the outer shell so that the inner shell is not prevented from deforming as the ink therein is consumed. In other words, the deformation is regulated, dominantly by the aforementioned support portion.

In this embodiment, either of the aforementioned blow molding methods is acceptable. This time, however, processing based on the direct blow molding method will be described in detail with reference to FIGS. 2 and 3.

Figure 3:
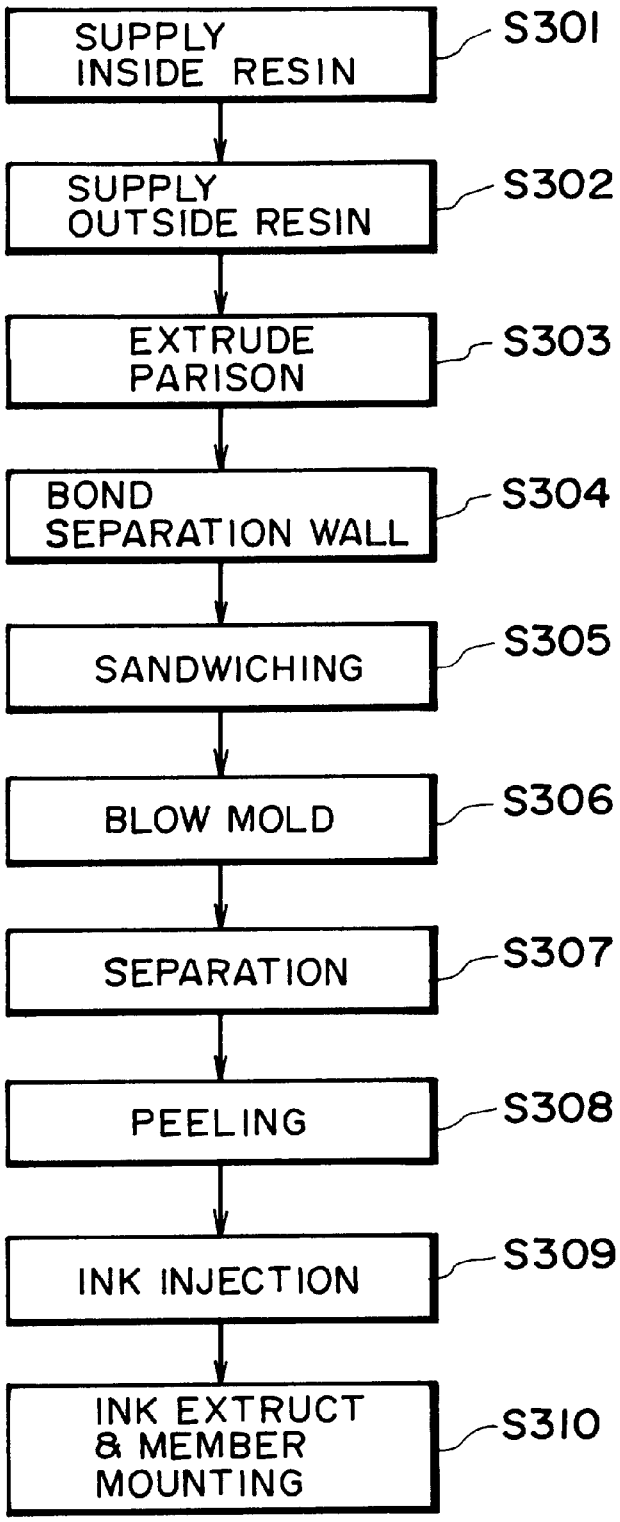
FIG. 3 is a flow chart for manufacturing the ink container described in the first embodiment of the present invention.

FIGS. 2(*a*)–2(*e*) depict various manufacturing steps for the ink container in this embodiment, and FIG. 3 is a flow chart depicting the ink container manufacturing sequence.

In FIG. 2, a reference numeral 201 designates a main accumulator for supplying the resin material for the inner shell; 202 denotes a main extruder for extruding the inner shell resin; 203 denotes an auxiliary accumulator for supplying the resin material for the outer shell; and 204 designates an auxiliary extruder for extruding the outer shell resin.

Referring to FIG. 2(*a*), the inner shell resin and the outer shell resin are supplied by the respective accumulators to a die 206 (steps S301 and S302) through a ring 206, forming a substantially cylindrical parison 207 integrally comprising the inner shell resin portion and the outer shell resin portion (step S303). In this case, the inner shell resin and the outer shell resin may be in contact with each other while being supplied, not necessarily entirely in contact with each other, or may be only partially in contact with each other. When allowing the resins to be in contact with each other, the shell materials must be properly selected so that the inner shell resin and the outer shell resin are prevented from fusing to each other at their interface, or a chemical compound must be added to one of the materials when the material is supplied to the die, so that the inner and the outer shell can be separated after molding. When it is necessary to use materials belonging to the same group for the sake of the liquid contact related properties or the configuration of the ink container, the inner shell wall and the outer shell may be given a laminar structure, wherein various resin materials are supplied in such a manner that different materials are exposed on the mutually facing surfaces of the respective shells.

Next, referring to FIG. 2(*b*), the parison 207 is temporarily held between the die 210 for forming the internal configuration, whereby the portions of the inner shell parison are fused to create a fused portion 211 which will become the partition walls (step S304). Since the inner shell resin and the outer shell resin are not adhesive to each other, they do not adhere to each other even when the inner shell parison is pinched by the internal configuration molding die 210, with the outer shell parison being between the inner shell parison and the internal configuration molding die 210.

A die (metallic die) 208 for forming the external structure of the ink container is placed so as to be prepared for enclosing the parison 207, as shown in FIG. 2(*c*), and then is moved to enclose the parison 207 as shown in FIG. 2(*d*) (step S305). During this step, the end portion of the inner shell parison is fused, and this fused portion constitutes the pinch-off portion 104 which will be in connection to the aforementioned partition walls after the completion of the container. Referring to FIGS. 2(*b*) and 2(*c*), when the external configuration of the ink container is formed using a two piece die, it is preferable that the direction in which each piece of the two-piece diemold is moved to enclose the inner shell parison is rendered the same as the direction in which the end portion of the inner shell parison is pinched for fusion as shown in FIG. 2(*c*).

The die for forming the external configuration of the ink container may comprise a removable die for forming the pinched portions from which the partition walls is grown.

Next, referring to FIG. 2(*d*), an air nozzle 209 is inserted into each space separated by the partition wall forming fused portion 211, and air is blown into the space to form the ink container into the configuration shown in FIG. 2(*e*). During this step, each space separated by the fused portions is expanded into the ink holding portions, and the inner shell and the outer shell remain stuck together without a gap between them. As the space is expanded, the stretched wall of the inner shell parison begins to fuse with the stretched walls of the adjacent holding portions, growing as the partition wall, starting from the adjacencies of the fused portion 211, forming a structural wall thicker than the other structural walls. At the final stage of flowing, the parison is blown into the configuration given by the die 208 as shown in FIG. 2(*e*) (step S306).

The blow molding conditions, such as air pressure or duration, are adjusted to predetermined conditions so that the volumes of the ink holding portions are equalized as shown in FIG. 1. The blowing conditions may be varied, but in order to accomplish uniformity in the thickness of the partition wall, they are preferred to be rendered the same for all the chambers. It is also preferable that the space between the outer shell parison and the die is vacuumed to cause the parison to conform to the die.

Further, when the die temperature is kept within a range of ±30° C. from a reference temperature while molding, the difference in the wall thickness among the ink containers can be reduced during the manufacturing; therefore, such a temperature control is preferable.

Thereafter, the ink container is separated from the external configuration forming die 203 (step S307). Then, after the external surface of the inner shell is separated from the internal surface of the outer shell (step S308), ink is injected (step S309). Next, the ink releasing member is attached (step S310). As for the method for separating the outward facing surface of the inner shell and the inward facing surface of the outer shell, there are a method in which the formable resin materials for the inner shell and the outer shell are differentiated in coefficient of thermal expansion (thermal contraction), a method which employs vacuuming, and the like. Referring to FIG. 1(*a*), when the air inlet opening is to be located at a location other than the pinch-off portion, the air inlet opening can be easily drilled while the inner shell is separated from the outer shell by vacuuming; therefore, such a locational arrangement is preferable. The ink is injected after the step for separating the outward facing surface of the inner shell from the inward facing surface of the outer shell, so that as described above, the outward facing surface of the inner shell and the inward facing outer shell, which are stuck together, can be satisfactorily separated, and therefore, the deformation can be reliably controlled due to the presence of the fused portion, and the partition walls partitioning the ink holding portions, and also due to the elastic deformation, the plastic deformation, and the like, of the resin materials.

When the parison 207 is processed using the blow molding method described above, the parison 207 is kept in a viscous state; therefore, both the inner shell resin and the outer shell resin do not develop directional properties.

The ink container is molded so that the thicknesses t and T of the inner shell resin and the outer shell resin, respectively, before the blow molding, become smaller than the thicknesses t1 and T1 of the inner shell resin and the outer shell resin, respectively, after the blow molding; according to an aspect of the present invention, the ink container is molded so that the relationship in thickness between the outer shell resin and the inner shell resin satisfies the following formula:

$$T>t$$

$$T1>t1$$

The employment of blow molding can reduce the number of manufacturing steps and the number of the components, which in turn can improve yield, and also allows the inner shell 102 to be formed in such a manner that the edges and corners of the inner shell 102 are set in those of the outer shell 101 in an orderly manner.

In other words, when the ink container is in the initial state, that is, the state immediately after the ink is injected in the ink container, the outer shell 102 and the inner shell 102 are similar in external configuration; therefore, the inner shell 102 snugly fits within the outer shell, holding a predetermined gap between them. As a result, a large dead space found in the conventional ink container comprising an outer shell and an ink containing pouch enclosed therein can be eliminated, increasing the amount of the ink holdable per unit volume of the outer shell (ink holding efficiency can be improved).

As described before, the locations of the partition walls (space partitioning walls) 109 are controlled dominantly by the configuration of the ridge portions of the partition wall forming die 210; therefore, the configuration of the in holding portion can be optionally selected so that all the ink holding portions may be rendered the same, similar to each other, or not similar to each other, simply by making the ridge portions straight as described in this embodiment, or curved. Also, the volumetric ratio among the ink holding portions can easily set by the same method.

In other words, the configuration of the ink holding portion is optional; therefore, the location of the port through which the ink is delivered to the recording means becomes optional. As a result, the ink drawing portion of the ink jet head can be optionally located, affording more latitude in the ink jet head design.

FIG. 4 depicts an example of the ink container in which the volumetric ratio of each ink holding portion is differentiated from those of the others.

In FIG. 4, the partition walls are so arranged that the ink holding portions become different in internal volume. This is accomplished during the step illustrated in FIG. 2(*b*), mainly by forming the fused portion 211 so as to extend at different angles relative to the direction in which the parison is extruded, instead of forming the fused portions 211 in parallel to each other. As for other methods for differentiating the ink holding portions in internal volume, varying the conditions under which the air is blown into each ink holding portion can be listed.

With the above described arrangement, the volumetric ratio among the ink holding portions can be matched to the usage ratio among a plurality of commonly used inks. As a result, a structure capable of improving the efficiency with which the plurality of inks held in the ink container are utilized can be easily realized.

FIG. 5 is a schematic drawing depicting a modified version of the ink container in the first embodiment of the present invention, depicting a different ink container structure, (*a*) being a sectional view and (*b*) being a side view.

In case of this modified version, the air venting mechanism is different from those depicted in FIGS. 1 and 4.

Also in this case, in order to prevent ink evaporation, to equalize the internal pressure of the ink container, and to prevent ink leakage, the ink container is given the double-wall structure, as shown in FIGS. 1 and 4, comprising two walls which are different in thickness, so that the inner shell easily accommodates the change in the internal pressure.

Further, the outer shell 101 and the inner shell 102 are formed of different materials, and the difference in thermal contraction between the two materials, and the residual stress resulting from the difference, and the like, are utilized to form a gap 107, that is, to separate the fused portion 104 of the inner shell 102 from the joint at which the inner shell 102 and the outer shell are in contact.

Further, the outer shell is provided with a valve 108 which opens outward to assist in maintaining the pressure balance for the inner shell.

When the ink is normally supplied, the pressure is satisfactorily adjusted as air enters, or exits from the space between the outer shell and the inner shell through the gap 107. However, a sudden pressure change, which occurs when the ink container is dropped, or in the like situations, must be quickly dealt with; therefore, the valve 108 is provided.

With the provision of the valve 108, an accidental pressure increase can be easily dealt with; therefore, the reliability of the ink container is further improved.

Embodiment 2

FIG. 6 is a schematic drawing depicting the structure of an ink container manufactured using a method different from the method used in the first embodiment, (*a*) being a sectional view and (*b*) being a side view.

Also in this embodiment, the inner shell and the outer shell of the ink container are formed at the same time in a single step using the blow molding method.

In the ink container 100 illustrated in FIG. 6, a reference numeral 101 designates the outer shell of the ink container, and a reference numeral 102 designates the inner shell of the ink container. The ink container 101 is structured so that the outer shell 101 and the inner shell 102 are separated by a space which contains air.

In this embodiment, the plurality of ink holding spaces are not created by partitioning the internal space of the inner shell 102. Instead, they are created by disposing a plurality of ink holding chambers independently formed of resin material, in parallel and in contact with the adjacent ones, and then fusing the interfaces between the adjacent ones. This means that the structure in which the inner shell comprises a plurality of the ink holding portions like the structure described in the first embodiment can be created by blow molding the plurality of mutually adhesive ink holding portions.

In this case, the wall portion (partition wall) between the adjacent two ink holding portions is formed as the result of the fusion between the structural walls of the adjacent two independent ink holding portions; therefore, this portion becomes thicker than the other structural walls of the ink holding portions. In other words, also in this embodiment, the partitioning wall, which is parallel to the thickness direction of the flat configuration, and partitions the ink holding space of the inner shell, is thicker than the other structural walls.

The material for the plurality of the ink holding chambers which constitute the inner shell, and the material for the outer shell, are optionally selected in any combination as long as the following conditions are satisfied; they are not adhesive to each other, and the material for the plurality of the ink holding chambers must be such that the independently formed ink holding portions become adhesive to each other.

Each ink holding portion is provided with an ink releasing port (ink supply port) 103 as in the first embodiment.

Also, each ink holding portion is provided with a supporting portion 104, that is, the fused portion, created by fusing the end portion of each ink holding portion in such a manner that the internal spaces of the inner shell 102 become sealed. The supporting portion is disposed on the opposite side from the ink releasing port 103 across the internal space.

Therefore, the deformation of the ink holding portion, which occurs as the ink is consumed, is controlled by this supporting portion 104, the ink supply port 103, and the aforementioned thick partition wall 111 resulting from the fusion of two ink holding portion walls.

The negative pressure in this embodiment is generated as the wider structural walls (which also constitute the structural walls of the inner shell) of each ink holding portion 110 deform inward, which is the same as the first embodiment. The edge portion and the partition wall 111 of the ink holding portion barely deforms, and instead, functions to regulate the elastic or plastic deformation of the structural wall. The edge portion of the inner shell 102 is initially in contact with the outer shell 101. The structural wall which mainly deforms is the wall which is parallel to the surface of FIG. 6, that is, the lateral wall of the flat container.

A reference numeral 105 designates an air vent through which air is introduced between the inner shell 102 and outer shell 101 when the volume of the inner shell 102 decreases due to ink consumption, and a reference numeral 106 designates an ink releasing member which constitutes the joint between the ink container and an ink jet head.

Next, a manufacturing method for the ink container of this embodiment will be described.

Figure 7:
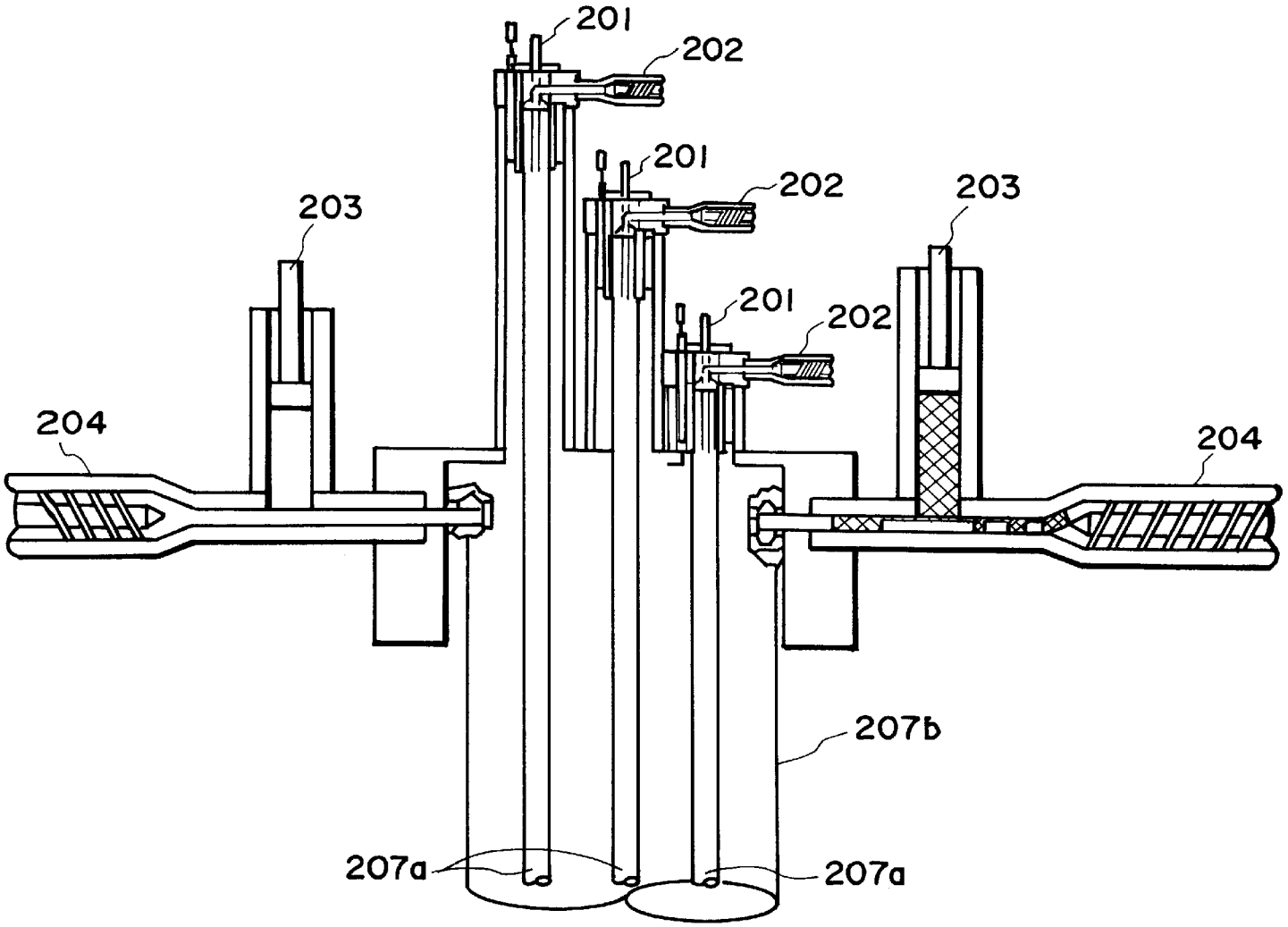
FIG. 7 is a schematic drawing of an example of an apparatus for manufacturing the ink container in the second embodiment of the present invention.
Figure 8:
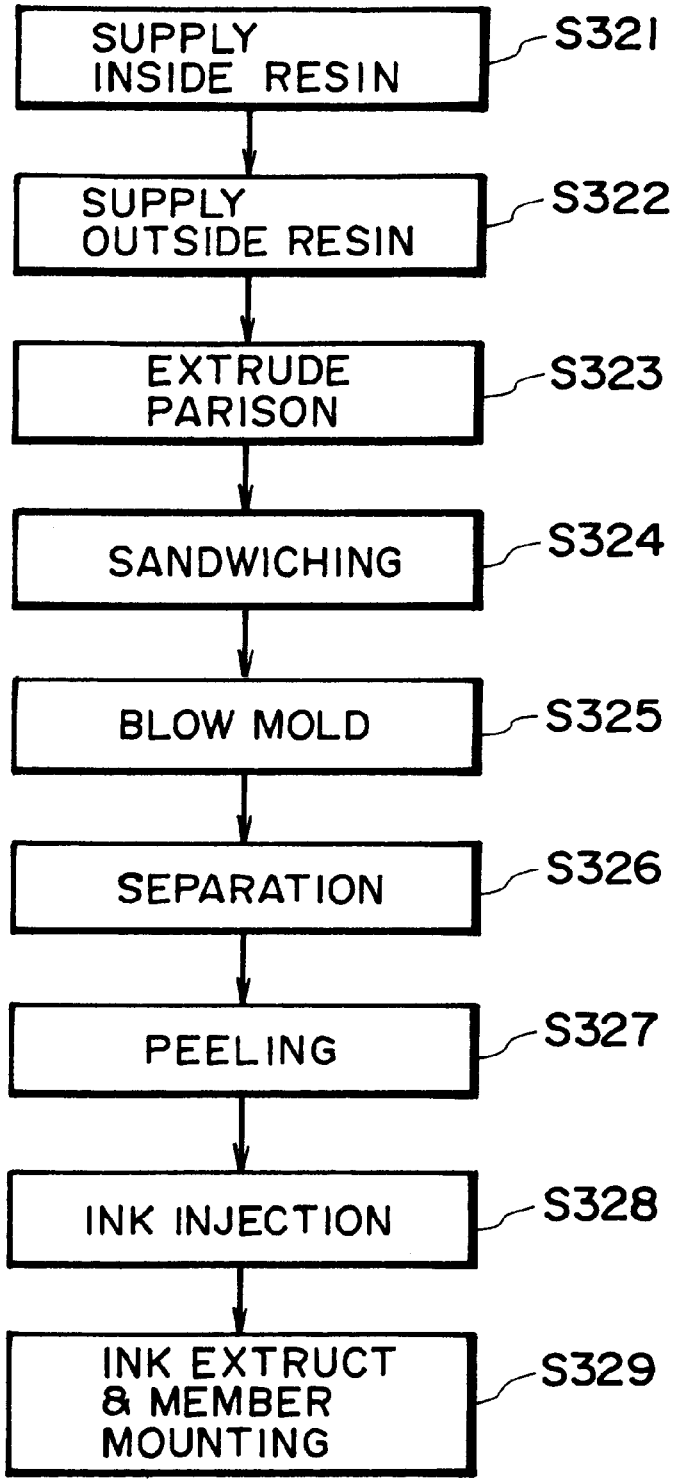
FIG. 8 is a flow chart showing the manufacturing of the ink container described in the second embodiment of the present invention.

FIG. 7 is a schematic dawning of the ink container manufacturing apparatus of this embodiment, and FIG. 8 is a flow chart showing the manufacturing sequence for the ink container.

In FIG. 7, a reference numeral 201 designates a main accumulator for supplying the resin material for the inner shell; 202 denotes a main extruder for extruding the inner shell resin; 203 denotes an auxiliary accumulator for supplying the resin material for the outer shell; and 204 designates an auxiliary extruder for extruding the outer shell resin.

Referring to FIG. 7, the number of main accumulator 201 is matched with the number of ink holding portions necessary in the ink container. A plurality of inner parisons 207*a* for forming the ink holding portion are formed by these main accumulators 201, within the outer parison 207*b* for forming the outer shell, which is formed by the material supplied from the auxiliary accumulator 203. In this embodiment, three inner parisons 207*a* are prepared for yellow, magenta, and cyan inks for color recording. They are disposed in parallel in the outer parison 207*b*.

The ink container is manufactured by this manufacturing apparatus using the following steps.

First, the inner resin and the outer resin are supplied (steps S321 and S322), and extruded so that the plurality of the parisons 207*a* are formed within the parison 207*b* (step S323).

Next, the parison 207*a* and 207*b* are sandwiched by a two-piece die arranged so as to sandwich the end portions of the parisons (step S324), whereby the end portions of the inner parisons are fused, creating portions which will become separate fused portions 104 belonging to the ink holding portions, one for one, after the completion of the ink container.

Then, air is injected into each inner parison from the air nozzles provided one for one, whereby the sealed spaces resulting from the fusion of the end portion of the inner parison, which is to become the ink holding chamber, is expanded. As a result, adjacent inner parisons come in contact with each other, gradually fusing at the interface. Then, more air is blown into the parisons to cause the parisons to conform to the die, forming an ink container in the final configuration (step S325).

Thereafter, the ink container is separated from the die (step S326), and the inner shell is separated from the outer shell (step S327). Then, ink is injected (step S328), and is sealed after the ink releasing member is attached (step S329).

Also in this embodiment, when the parison is processed using the blow molding method described above, the parison is kept in a viscous state; therefore, both the inner shell resin and the outer shell resin do not develop directional properties.

The ink container is molded so that the thicknesses t and T of the inner shell resin and the outer shell resin, respectively, before the blow molding, become smaller than the thicknesses t2 and T2 of the inner shell resin and the outer shell resin, respectively, after the blow molding; according to an aspect of the present invention, the ink container is molded so that the relationship in thickness between the outer shell resin and the inner shell resin satisfies the following formula, as in the first embodiment:

$$T>t$$

$$T2>t2$$

In the case of the manufacturing method of this embodiment, when the same material is used for all ink holding chambers, all ink holding chambers are preferred to be substantially the same in configuration. However, when the volumetric ratios of the ink holding chambers are preferred to be different, it is necessary to select a different material for each ink holding chamber, and further, to adjust the air blowing conditions such as pressure, duration, and the like.

The employment of the blow molding of this embodiment can reduce the number of manufacturing steps and the number of the components, which in turn can improve yield, and also allows the inner shell 102 to be formed in such a manner that the edges and corners of the inner shell 102 are set in those of the outer shell 101 in an orderly manner.

In other words, when the ink container is in the initial state, that is, the state immediately after the ink is injected in the ink container, the outer shell 101 and the inner shell 102 become similar in external configuration; therefore, the inner shell 102 snugly fits within the outer shell, holding a predetermined gap between them. As a result, a large dead space found in the conventional ink container comprising an outer shell and an ink containing pouch enclosed therein can be eliminated, increasing the amount of the ink holdable per unit volume of the outer shell (ink holding efficiency can be improved).

Figure 9A:
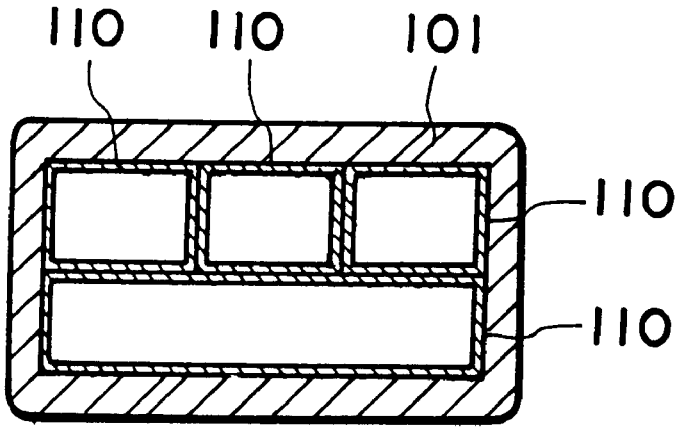
FIGS. 9(*a*) and (*b*) comprise is a schematic drawing depicting different ink container structures in the second embodiment of the present invention.
Figure 9B:
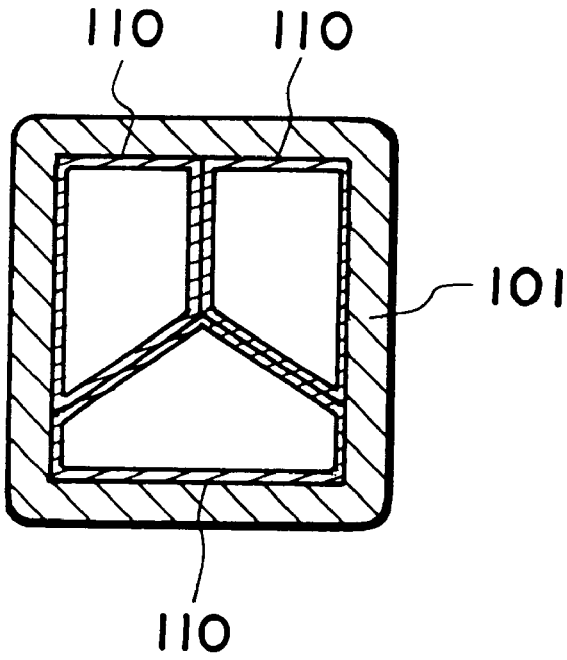

Further, the ink holding chambers may be arranged in a manner other than in parallel, that is, a manner different from the first embodiment. FIGS. 9(*a*) and 9(*b*) are schematic sections depicting such an arrangement.

FIG. 9(*a*) depicts an arrangement for holding four different inks, wherein the amount of black ink which is most frequently used for recording may be increased by reducing the amounts of the cyan, magenta, and yellow inks used for color recording to one third the amount of black ink. FIG. 9(*b*) depicts an arrangement in which the partition walls form substantially a Y configuration so that the ink releasing ports can be disposed at equal distances.

In FIG. 9, which is a schematic drawing, the adjoining walls of adjacent ink holding portions give a linear configuration, but it is not necessary for them to be linear as long as the ink holding chamber wall which deforms first as ink is released is constituted of the ink holding chamber wall facing the internal surface of the outer shell.

In the case of the structure illustrated in FIG. 9, all partition walls between the adjacent two ink holding chambers 110 are not parallel to the thickness direction of the flat configuration, which is different from the preceding embodiment. In other words, in this embodiment, even the wider wall may contact the wall of the adjacent ink holding chamber. Therefore, in order to generate stable negative pressure, it is preferable that the adjoining walls of adjacent ink holding chambers are not fused. This can be accomplished by selecting the resin materials for the ink holding chambers so that a material selected for one ink holding chamber is not adhesive to the materials selected for the other ink holding chambers. In this case, the edge portions and the corners of one ink holding chamber do not become dislodged from those of the adjacent ink holding chamber, remaining in contact with each other, even while ink is released; therefore, even after the ink is substantially consumed, the deformation of each ink holding chamber can be controlled. As a result, the negative pressure can be stabilized.

This embodiment may be applied to the ink container illustrated in FIG. 6 in which all adjoining portions between adjacent ink holding chambers are parallel to the thickness direction of the flat configuration. In other words, the resin material for the ink holding chambers may be so selected that a material selected for one ink holding chamber is inadhesive to the materials for the other ink holding chambers, rendering the ink holding chambers inadhesive to each other. Also in this case, the edge portions and the corners of the ink holding chamber are barely displaced even while ink is released; therefore, the deformation of the ink holding chamber can be regulated.

FIG. 10 is a schematic drawing depicting a modified version of the ink container described in the second embodiment of the present invention, depicting a different ink container structure, (*a*) being a sectional view and (*b*) being a side view. In case of this modified version, the air venting mechanism is different from those depicted in FIG. 6.

The outer shell 101 and the inner shell 102 are formed of different materials, and the difference in thermal contraction between the two materials, and the residual stress resulting from the difference, and the like, are utilized to create a gap 107, that is, to separate the fused portion 104 of the inner shell 102 from the joint at which the inner shell 102 and the outer shell are in contact. Further, the outer shell 101 is provided with a valve 108 which opens outward to assist in maintaining pressure balance for the inner shell.

Other Embodiments

Figure 11A:
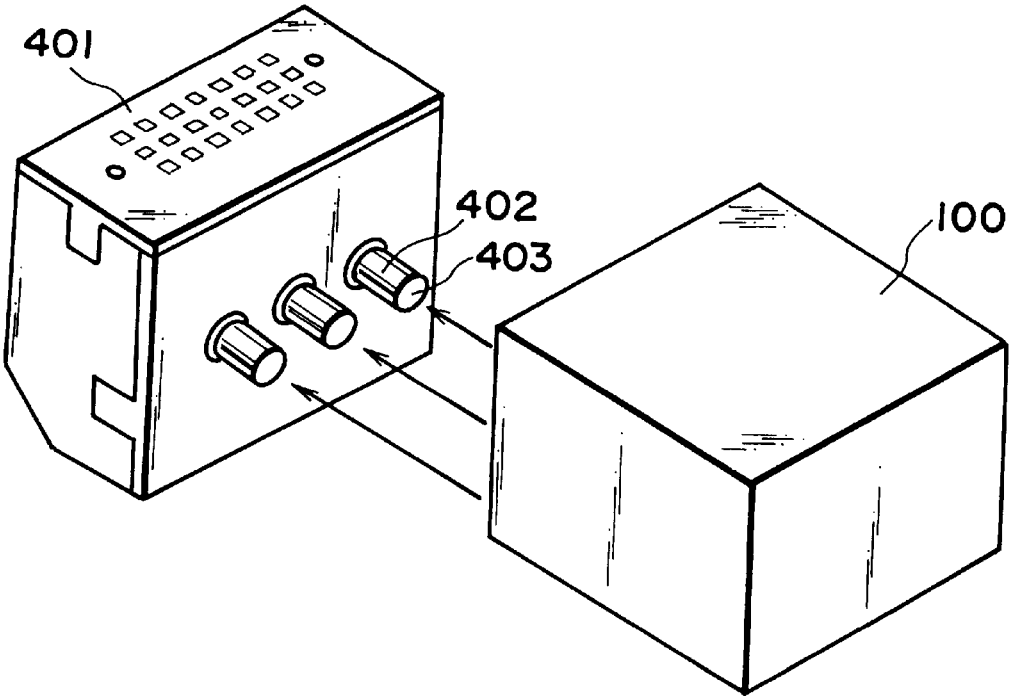
FIG. 11 is a schematic perspective view (*a*) of a recording head connectable to the ink container in accordance with the present invention, and schematic section (*b*) depicting how the recording head is connected to the ink container.
Figure 11B:
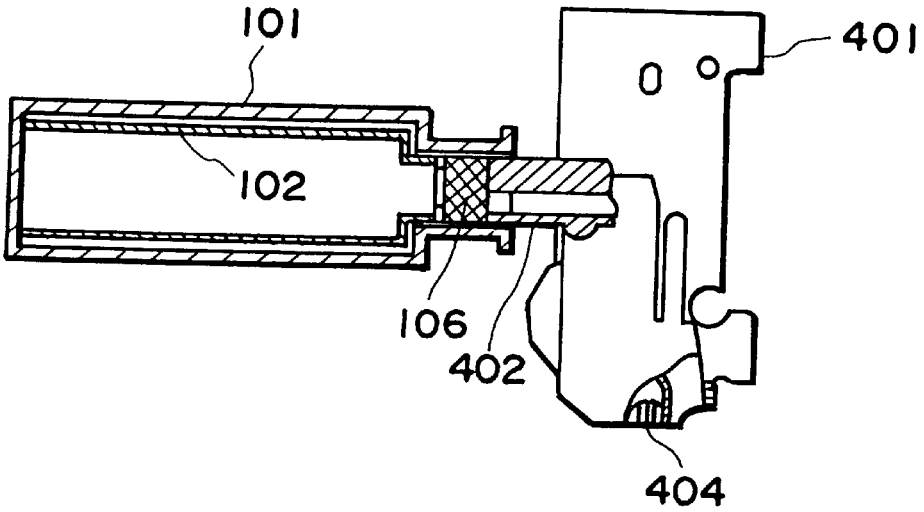

In the preceding embodiments, structures comprising a plurality of ink holding chambers were described. However, the ink combination for color recording is not limited to the combination of yellow, magenta, and cyan inks; the structure may comprise four or more ink holding chambers for holding black ink or other specific color inks in addition to the above three color inks (FIG. 11). Further, the structure may be such that inks with the same color but with different density may be individually held in their own ink holding chambers.

It is also possible to set up a combination of an ink holding chamber and a waste ink holding chamber. However, in such a case, the joint portion (formed like an ink supply port of the ink holding chamber) of the waste ink holding chamber, at which external access is permitted, must be provided with a structure through which liquid can be introduced into the waste ink holding chamber from outside.

As for resin materials for the inner shell in each of the preceding embodiments, polypropylene resin or polyethylene resin is preferable. As for resin materials for the outer shell, HIPS (high impact polystyrene) resin or Noryl (available from GE) resin is preferable. HIPS resin is noncrystalline, comprising few crystalline structures. Polypropylene resin or polyethylene resin are crystalline.

Generally, noncrystalline resin has a smaller coefficient of thermal contraction, and crystalline resin has a larger coefficient of thermal contraction.

Plastic material such as polystyrene, polycarbonate, polyvinyl chloride, and the like, may be listed as noncrystalline materials other than those listed above. Polyacetal, polyamide, and the like, may be listed as crystalline material since each of them forms crystalline structure by a certain ratio when placed in a specific environment.

The crystalline plastic has a glass transition temperature (Tg: temperature at which molecule begins Brownish motion, and transition from glassy state to rubbery state occurs), and a relatively distinct melting temperature. On the other hand, noncrystalline plastic has a glass transition temperature, but no distinct melting point.

The mechanical strength, specific volume, specific heat, coefficient of expansion, or the like, of plastic material suddenly changes at the glass transition point or the melding point. This property of plastic material can be utilized to create such material combinations that improve the separability of the inner shell resin from the outer shell resin. For example, when Noryl resin, which is noncrystalline, is used for the outer shell, and polypropylene resin, which is crystalline, is used for the inner shell, the outer shell will be provided with mechanical strength, and the inner shell will be provided with flexibility and a larger coefficient of thermal contraction.

A polymer whose molecular structure comprises only C—C bonds and C—H bonds is called a nonpolar polymer, whereas a polymer whose molecular structure comprises a large amount of polar atoms such as O, S, N or halogen is called polar polymer. Polar polymer displays larger intermolecular cohesive force; therefore, polar polymer resin displays stronger bonding force.

This property of polymer resin can be used to improve the separability of resin material; a combination of two nonpolar resins, or a combination of a nonpolar resin and a polar resin, can be used to improve the separability of one resin material from the other resin material.

In the preceding embodiments, the outer shell and the inner shell were described as a shell with single layer walls. However, these walls may be given a laminar structure comprising multiple layers of different materials in order to improve shock resistance. In particular, damage which occurs when an ink container is transported or installed, or in the like situations, can be prevented by giving the outer shell the multi-layer wall structure.

As for the material for the inner shell of the ink container in accordance with the present invention, polyethylene resin, polypropylene resin, and the like, are usable as described above, and their tensile elastic modulus are preferred to be within a range of 150–3000 kgf/cm$^2$.

Next, how to connect the ink container described in each of the preceding embodiments to an ink jet recording apparatus will be described. FIG. 11(*a*) is a schematic perspective view of a recording head, that is, a recording means, connectable to the ink container in accordance with the present invention. FIG. 11(*b*) is a schematic section depicting the state of connection between the recording head and the ink container.

In FIG. 11(*a*), a reference numeral 401 designates a recording head unit as the recording means, which integrally comprises the recording heads for printing black, yellow, cyan, and magenta colors, being capable of printing in full color. A reference numeral 402 designates an ink supply tube through which ink is introduced into each recording head. One end of the ink supply tube 402 is provided with a filter 403 for trapping a bubble or dirt.

Referring to FIG. 4(*b*), the aforementioned ink container 100 is attached to the recording head unit 401 so that the ink supply tube 402 for each ink is connected to the corresponding ink releasing compressible member 106 to enable the ink to be released.

After the ink container is attached, the ink within the ink container is introduced into the recording head side by a recovery means or the like provided in the unillustrated recording apparatus, whereby an ink flow path filled with the ink is established. Thereafter, the ink held in the inner shell of the ink container can be ejected, that is, consumed, from an ink ejecting portion 404 provided in the recording head, while the recording head is in action.

Figure 12:
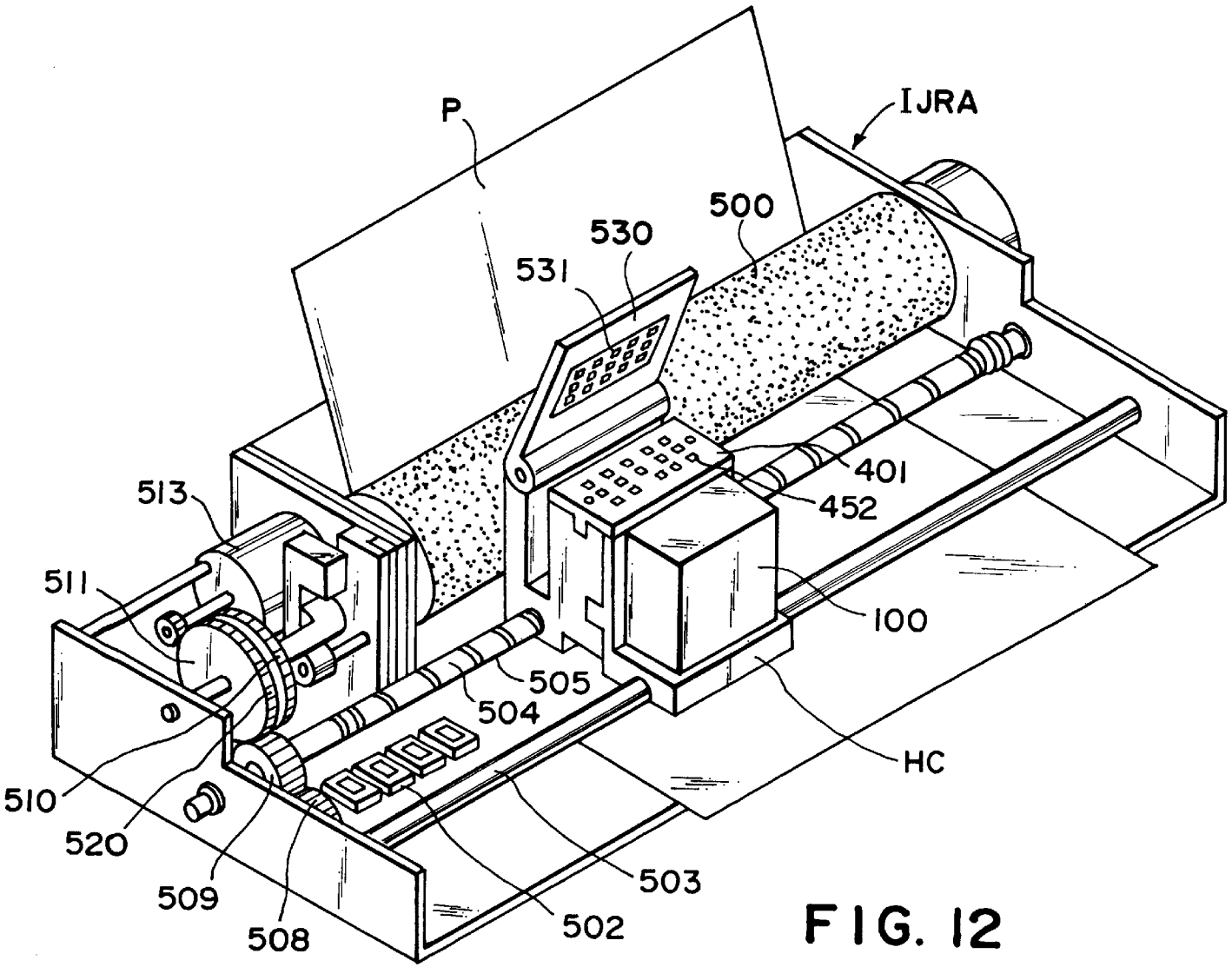
FIG. 12 is a schematic perspective view of an ink jet recording apparatus installable into the ink container in accordance with the present invention.

Lastly, an ink jet recording apparatus in which the ink container in accordance with the present invention is mounted for recording will be described. FIG. 12 is a schematic view of an ink jet recording apparatus which is compatible with the ink containers described in the embodiments of the present invention.

In FIG. 12, the head unit 401 and the ink container 100 are rigidly but removably mounted on the carriage provided on the main assembly side of the ink jet recording apparatus, with the use of an unillustrated positioning means.

The forward and backward rotation of an driving motor 513 is transmitted to a lead screw 504 through driving force transmission gears 511 and 509, rotating the lead screw 504. The lead screw 504 is provided with a helical groove which engages with an unillustrated pin provided on the carriage. With this arrangement, the carriage is reciprocally moved in the longitudinal direction of the apparatus.

A reference numeral 502 designates a cap for capping the front surface of each recording head within the recording head unit. Also, it is used for restoring the recording head performance, the ink is sucked through the opening of the cap by an unillustrated sucking means. The cap 502 is moved by the driving force transmitted through a gear 508 and the like, being enabled to cover the ejection surface of each recording head. Adjacent to the cap 502, an unillustrated cleaning blade is disposed so as to be movable in the vertical direction of this drawing. The configuration of the blade is not limited to the form depicted in the drawing, and needless to say, any known cleaning blade is compatible with the present invention.

The apparatus is structured so that an appropriate operation among the capping, cleaning, and performance recovery sucking operations is performed at a pertinent position by the function of the lead screw 505 when the carriage is at its home position, it is also needless to say that any structure is compatible with the present invention as long as the structure can enable a proper operation to be performed with known timing.

When the recording head unit is mounted on the carriage, the connection pad 452 of the recording head unit is connected to the connection pad 531 of a connection plate 530 provided on the carriage, whereby an electrical connection is established. This connection occurs as the connection pad 530 is rotated about its axis. Since this electrical connection is established without using a connector, the recording head is not subjected to unnecessary force.

As described above, according to the present invention, an ink container is provided with a double structure comprising an outer shell, and an inner shell containing a plurality of ink holding portions, wherein the walls of the inner shell in which ink is held are substantially in contact with the outer shell; therefore, ink holding efficiency relative to the space occupied by the outer shell is substantially 100%. Further, the number of ink container components is reduced; therefore, it is possible to reduce the number of quality control provisions, to simplify the ink container manufacturing process, and to easily meet a practical level of accuracy required with manufacturing the ink container. As a result, it is possible to provide an inexpensive ink container manufacturable with a preferable yield.

Since a regulating portion for regulating the irregular deformation of the inner shell is provided, the negative pressure for supplying a plurality of different inks is stabilized, and the inner shell delicately deforms to counter the external mechanical force, the temperature fluctuation, and the pressure fluctuation; therefore, ink is smoothly supplied to an ink jet head. In addition, this pressure is generated without the need for placing an ink absorbent member capable of generating capillary force or the like, in the ink container; therefore, the number of inks holdable in the ink container can be increased.

Further, the ink container in accordance with the present invention is manufactured using blow molding; therefore, it is better sealed, and also is more preferably in terms of the prevention of ink evaporation and the deterioration of ink which occurs when stored for a long time, than a conventional ink container manufactured by fusing or gluing a plurality of components. Further, there are less manufacturing restrictions regarding the formation of the plurality of ink holding portions; therefore, more latitude is afforded in designing.

While the invention has been described with reference to the structures disclosed herein, it is not confined to the details set forth and this application is intended to cover such modifications or changes as may come within the purposes of the improvements or the scope of the following claims.

What is claimed is:

1. An ink container for containing ink for ink jet recording, comprising:

an inner container having a plurality of adjacent accommodating chambers for accommodating the ink and ink supplying portions corresponding to respective accommodating chambers;

an outer casing for enclosing an outer side of said inner container, wherein the outer casing is substantially-polygonal-prism shaped, and the inner container has a substantially flat surface which first deforms with consumption of liquid; and a common air vent common to all of said accommodating chambers and formed in said outer casing;

wherein a negative pressure is produced in said ink container when the ink is discharged from said ink container;

wherein said inner container and outer casing are composed of resin materials which are substantially non-stretched, and adjacent ones of said chambers of said inner container are composed of the substantially non-stretched material and closely contact each other in an initial stage in which said container is filled with the ink and are deformable independently from each other when the ink is discharged from said ink container while producing a negative pressure in the chambers, wherein the resin materials of said inner container and said outer casing have different thermal contraction rates, wherein the inner container has corners corresponding to corners of the outer casing and wherein the outer casing has inner container deformation limiting portions for limiting deformation of said inner container.

2. A container according to claim 1, wherein a space is provided between said inner container and outer casing, and is in fluid communication with ambience.

3. A container according to claim 1, wherein the resin materials of said inner container and said outer casing have different thermal contraction rates.

4. A container according to claim 1, wherein the resin material of said inner container is crystalline resin material, and the resin material of said outer casing is non-crystalline.

5. A container according to claim 1, wherein at least one of the resin materials is non-polar.

6. A container according to claim 1, wherein a space is provided between said inner container and outer casing, and is in fluid communication with ambience.

7. A container according to claim 1, wherein said inner container has an outside of a particular configuration and wherein said outer casing has an inside of a particular configuration, wherein the configurations of the outside of said inner container and the inside of said outer casing are substantially similar to each other.

8. An ink container according to claim 7, wherein said inner container is separated from the outer casing with discharge of the ink therefrom.

9. A container according to claim 1, wherein a space is provided between said inner container and outer casing, and is in fluid communication with ambience.

10. A container according to claim 1, wherein each of said accommodating chambers has an area free of said inner container deformation limiting portion.

11. A container according to claim 1, wherein said inner container deformation limiting portions are located opposed to each other.

12. A container according to claim 11, wherein said nipped portion is provided at a side opposed to said ink supply portion.

13. A container according to claim 1, wherein one of said inner container deformation limiting portions functions as an ink supplying portion.

14. A container according to claim 13, wherein the ink supply portion is provided with an ink leakage preventing member for preventing ink leakage.

15. A container according to claim 14, wherein said ink leakage preventing member includes a rubber plug, a fibrous material, a porous material, a valve or a filter.

16. A container according to claim 1, wherein one of said inner container deformation limiting portions comprises a nipped portion where a part of said inner container is nipped by said outer casing.

17. A container according to claim 16, wherein said nipped portion has a length shorter than a length of a side having the nipped portion.

18. A container according to claim 1, wherein one of said inner container deformation limiting portions is a partition wall between the adjacent accommodating chambers.

19. A container according to claim 18, wherein said container comprises said partition wall and a non-partition wall which does not partition adjacent accommodating chambers, wherein the partition wall has a thickness larger than a thickness of the non-partition wall.

20. An ink container according to claim 1, wherein boundary portions between adjacent chambers are separable from each other.

21. An ink container according to claim 20, the adjacent chambers are composed of different material.

22. An ink container according to claim 1, wherein at least one of said accommodating chambers is larger in a volume than another accommodating chamber.

23. An ink jet cartridge, comprising:

an ink inner container comprising:

an inner container having a plurality of adjacent accommodating chambers for accommodating ink and ink supplying portions corresponding to respective accommodating chambers;

an outer casing for enclosing an outer side of said inner container, wherein the outer casing is substantially-polygonal-prism shaped, and the inner container has a substantially flat surface which first deforms with consumption of liquid; and a common air vent common to all of said accommodating chambers and formed in said outer casing;

wherein a negative pressure is produced in said ink container when the ink is discharged from said ink container;

an ink jet head, connectable with at least one of said ink supplying portions, for ejecting the ink;

wherein said inner container and outer casing are composed of resin materials which are substantially non-stretched, and adjacent ones of said accommodating chambers of said inner container are composed of a substantially non-stretched material and closely contact each other in an initial stage in which said container is filled with the ink and are deformable independently from each other when the ink is discharged from said ink container while producing a negative pressure in the chambers, wherein the resin materials of said inner container and said outer casing have different thermal contraction rates, wherein said inner container has corners corresponding to corners of the outer casing, and wherein said outer casing has inner container deformation limiting portions for limiting deformation of said inner container.

24. A cartridge according to claim 23, wherein said ink jet head and ink container are detachably mountable relative to each other.

* * * * *

UNITED STATES PATENT AND TRADEMARK OFFICE

CERTIFICATE OF CORRECTION

PATENT NO. : 6,183,075 B1
DATED : February 6, 2001
INVENTOR(S) : Toshiaki Sasaki It is certified that error appears in the above-identified patent and that said Letters Patent is hereby corrected as shown below:

Title page,
Item [56], References Cited, FOREIGN PATENT DOCUMENTS, delete the following duplicate lines:
"0510665 10/1992 (EP).".
"0542247 5/1993 (EP).".
"0571151 11/1993 (EP).".
"0605183 7/1994 (EP).".
"0624475 11/1994 (EP).".
"0640482 3/1995 (EP).".

Column 5,
Line 26, "become" should read -- becomes -.

Column 6,
Line 47, "As" should read -- At --.

Column 7,
Line 50, "above described" should read -- above-described--.

Column 10,
Line 19, "in" should read -- ink --.
Line 45, "above-described" should read -- above-described --.

Column 12,
Line 25, "dawning" should read -- drawing --.

Column 18,
Line 1, "the" should read -- said --.
Line 2,"the" should read -- said --.
Line 3, "the" should read -- said --.

UNITED STATES PATENT AND TRADEMARK OFFICE

CERTIFICATE OF CORRECTION

PATENT NO. : 6,183,075 B1
DATED : February 6, 2001
INVENTOR(S) : Toshiaki Sasaki It is certified that error appears in the above-identified patent and that said Letters Patent is hereby corrected as shown below:

Column 20,
Line 15, "the" should read -- said --.

Signed and Sealed this

Twenty-second Day of January, 2002

*Attest:*

*Attesting Officer*

JAMES E. ROGAN
*Director of the United States Patent and Trademark Office*